United States Patent [19]

Nielsen

[11] 4,078,798

[45] Mar. 14, 1978

[54] TOY VEHICLE

[75] Inventor: Edwin A. Nielsen, Oceanside, N.Y.

[73] Assignee: Ideal Toy Corporation, Hollis, N.Y.

[21] Appl. No.: 747,442

[22] Filed: Dec. 6, 1976

[51] Int. Cl.[2] ..... A63H 18/12; A63F 9/14

[52] U.S. Cl. ..... 273/86 B; 46/251

[58] Field of Search ..... 273/86 B; 46/251, 253, 46/254, 255, 256, 257, 258, 259, 260, 261, 262; 320/21, 53, 59

[56] References Cited

U.S. PATENT DOCUMENTS

| | | | |
|---|---|---|---|
| 1,837,738 | 12/1931 | Vencill | 320/59 X |
| 2,832,177 | 4/1958 | Mueller | 46/251 |
| 3,813,812 | 6/1974 | Barlow et al. | 46/259 |

*Primary Examiner*—Anton O. Oechsle
*Attorney, Agent, or Firm*—Richard M. Rabkin

[57] ABSTRACT

A toy vehicle and toy vehicle game are disclosed in which a toy vehicle is used that is driven by an electric motor powered from a battery in the vehicle. The vehicle is operated on a track providing a current source therealong in the form of a plurality of current supply strips, and the toy vehicle includes an electrical circuit therein for collecting current from the track and trickle charging the battery. As a result the motor is continuously supplied with current from the battery and driven at a relatively constant rate of speed while the battery, in turn, is charged as the vehicle moves along the track.

17 Claims, 5 Drawing Figures

TOY VEHICLE

The present invention relates to toy vehicles and toy vehicle games, and more particularly to a drone car driven at a relatively constant rate of speed by a battery wherein the battery is trickle charged from the track on which the vehicle is operated.

Battery operated toy vehicles have been previously proposed in a variety of different types of configurations and for a variety of different uses. In some toy vehicle games the vehicles themselves contain small penlight type batteries and are driven along a track at a relatively constant speed in a simulated race game. However, because the players have no control over the vehicles the effective realism of the game is substantially reduced. In addition to this lack of realism the batteries in the vehicles rapidly lose their charge and must be replaced. To overcome the replacement problem it has been previously proposed to provide battery operated toy vehicles with rechargeable batteries and a recharging system. In such previously proposed devices, such as for example shown in one embodiment in U.S. Pat. No. 2,832,177, the vehicle is removed from the track along which it is operated and connected to a stationary source of current used to charge the battery. In another embodiment the vehicle travels in a closed path past a station which supplies recharging current to the battery and allows the vehicle to remain continuously in operation.

It is an object of the present invention to provide a battery operated toy vehicle whose battery can be charged during use of the vehicle.

Another object of the present invention is to provide a toy vehicle game in which a toy vehicle is driven at a relatively constant speed while a battery therein supplying power to the vehicle is trickle charged so that it is not necessary to remove the vehicle from the game during play.

Another object of the present invention is to provide a toy vehicle and toy vehicle game of the character described which is relatively simple and inexpensive in construction.

A still further object of the present invention is to provide a toy vehicle and toy vehicle race game which is durable and reliable in use.

In accordance with an aspect of the present invention a toy vehicle is provided which is adapted to be used in a toy vehicle race game of the type having a track and a plurality of current supply strips in the track along the path of travel for the toy vehicles thereon. One such toy vehicle game is disclosed in U.S. Patent Application Ser. No. 747,441 filed Dec. 6, 1976 and the divisional application therefrom U.S. Patent Application Ser. No. 783,833 filed Apr. 1, 1977. The disclosure of said U.S. Patent Applications Ser. Nos. 747,441 and 783,833 are incorporated herein by reference. In that type of game the track provides at least two lanes for toy vehicles, with power being supplied to the respective toy vehicles under the independent and separate control of the players so that each vehicle's speed of movement and its position along the track (i.e., its relative position in the respective lanes) can be independently controlled by the operators regardless of the lane in which the vehicles are located. The toy vehicle of the present invention is used in this track to provide, according to one feature of the invention, a drone for the game which moves along the track at a relatively constant speed.

The drone includes a frame having an electric motor mounted therein for driving at least one drive wheel of the vehicle. A battery is located in the vehicle and connected to the motor for supplying power thereto. Electrical current from the track is collected through current collectors which are operatively connected to the battery in order to trickle charge the battery as the vehicle is driven about the track. Preferably the vehicle includes means which will permit only current of a predetermined selected polarity to pass from the current collectors of the vehicle to the battery so that the battery is only subjected to the desired current flow for charging.

The above, and other objects, features and advantages of this invention, will be apparent in the following detailed description of an illustrative embodiment thereof, which is to be read in connection with the accompanying drawings, wherein.

Figure 1:
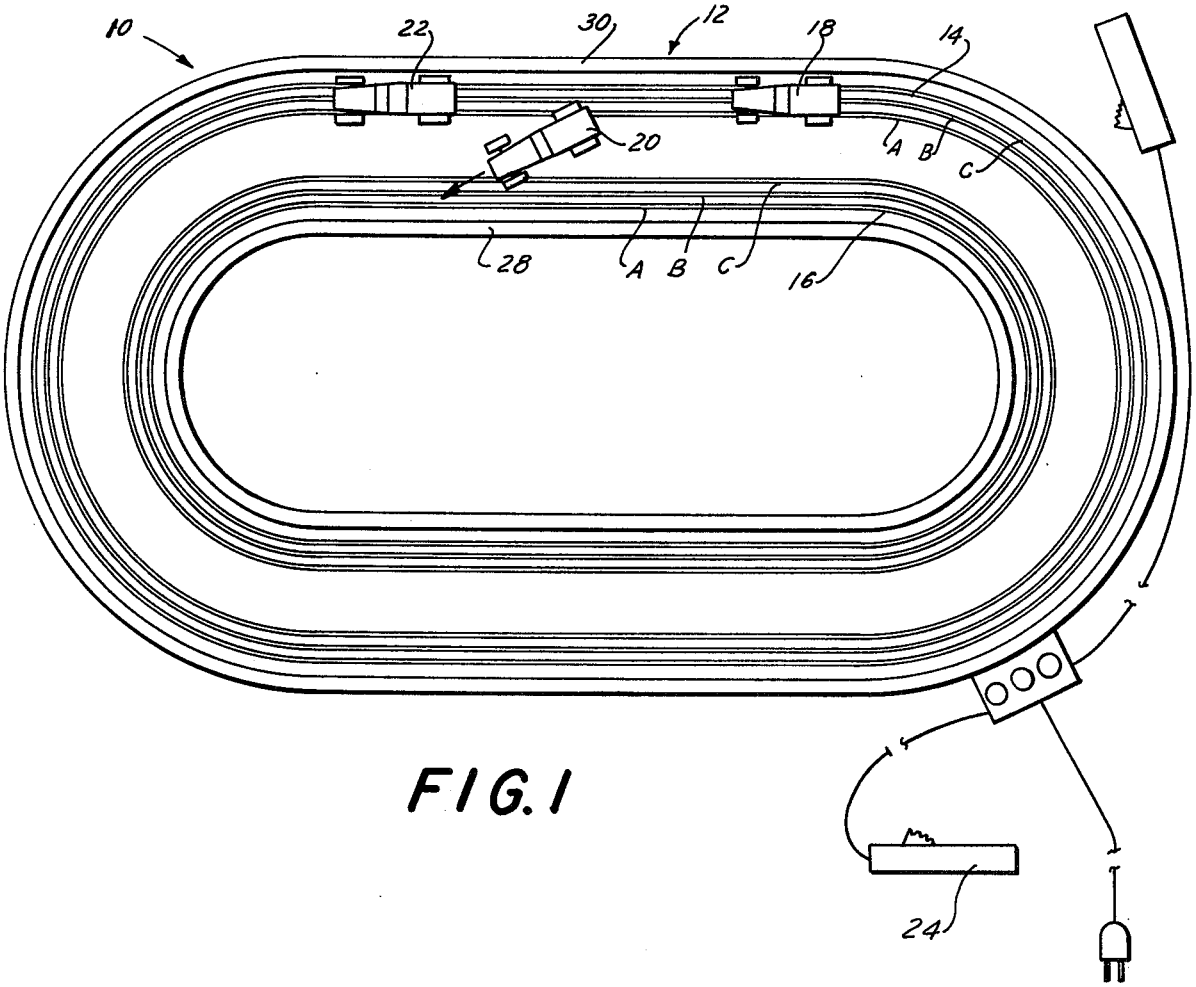
FIG. 1 is a plan view of a toy game within which the toy vehicle of the present invention is utilized.
Figure 2:
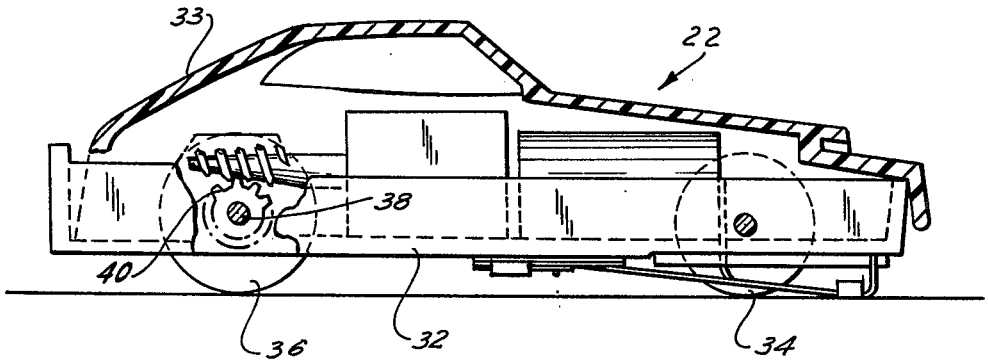
FIG. 2 is a longitudinal sectional view of the toy vehicle constructed in accordance with the present invention.
Figure 3:
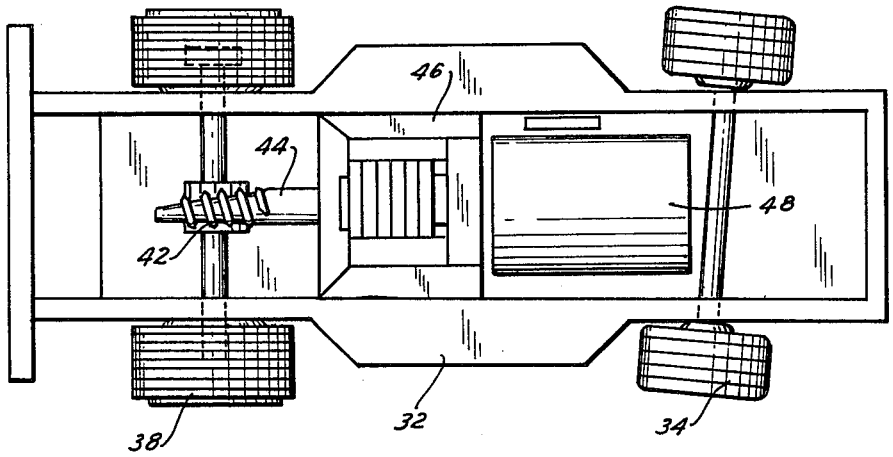
FIG. 3 is a plan view, with the body removed, of the toy vehicle illustrated in FIG. 2.

Referring now to the drawings in detail, and initially to FIG. 1 thereof, it will be seen that a game 10, in which the toy vehicle of the present invention is adapted to be utilized includes a track 12 defining two lanes 14, 16 along which operator controlled toy vehicles 18, 20 are adapted to move and pass each other. In accordance with the invention a drone car 22 is placed on the track to move along the track at a relatively constant rate of speed thereby presenting an obstacle to the vehicles 18, 20 which must be passed as the vehicles move around the track.

The game 10 is described in detail in the above U.S. Patent Applications Ser. Nos. 747,441 and 783,833, filed Dec. 6, 1976 and Apr. 1, 1977, respectively, and reference is made to said applications for a detailed description of the operation and structure thereof. Basically the game includes three conductive strips A, B, C embedded in each lane 14, 16 substantially flush with the track surface, with corresponding strips in each lane (i.e., strips A, strips B and strips C) being electrically connected to each other, and with strips C being connected to electrical ground. Strips A and B are respectively controlled by individual controllers 24, 26 operated by the players to control current supply thereto and to also control the polarity of current supplied to the toy vehicles. The latter are provided with current collectors on their lower surfaces respectively associated with the strips A or B so that, for example, vehicle 18 collects current only from the strips A under the control of controller 24 and vehicle 20 collects current only from the strips B. The drive arrangement of the vehicles 18, 20 is such that one or the other of their rear drive wheels is driven in accordance with the polarity of the current supplied to its associated contact strip so that the toy vehicle is driven against either the inner wall 28 or the outer wall 30 of the track 12 and will switch lanes as a result of a change in the selection of which rear drive wheel is powered. In this manner the operators have full control over the speed of movement of the toy vehicles 18, 20 and the lane in which the vehicle will move. This will enable the operators to turn their vehicles 18, 20 out of a lane to pass the drone car or to pass each other.

Figure 4:
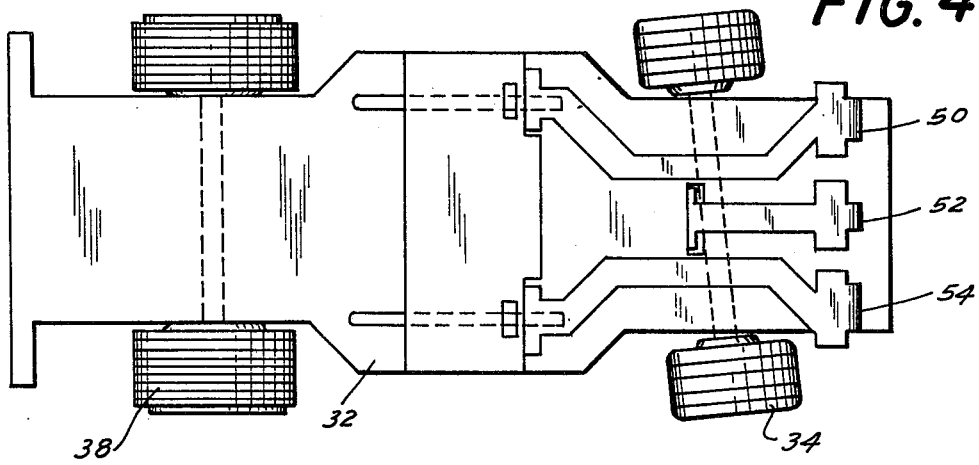
FIG. 4 is a bottom view of the toy vehicle.

Drone car 22 includes a frame 32, plastic body 33, and a pair of front and rear drive wheels 34, 36 respectively. The front wheels are preferably mounted in a slight angular relation in the longitudinal axis of the body so that the vehicle will always be driven toward and against one of the side walls of the track. Thus, as illustrated in FIG. 4 the wheels are canted slightly to the right so the vehicle will stay in the outer lane of the track. If the front wheels are instead canted to the left the vehicle will stay in the inner lane of the track. Alternatively the front wheels can be aligned straight on the frame. In that case, because of the effects of centrifugal force the drone car will normally move in the outer lane against outer wall 30, even if it is initially placed in the inner lane 16, because as the vehicle passes around a turn in the track it will be thrown by centrifugal force into the outer lane against outer wall 30. The rear drive wheels are fixed on a rear drive shaft 38 which has a centrally located spur gear 40 rigidly secured thereto. This spur gear is driven through a worm gear 42 mounted on the output shaft 44 of an electric motor 46 mounted on frame 32. Current is supplied to the motor 46 by a small rechargeable battery 48, of conventional construction, electrically connected to the motor in any convenient manner. In accordance with a feature of the present invention battery 48 is trickle charged from current supplied to contact strips, A, B of track 12 so that the battery maintains its charge and the vehicle moves around the track at a relatively constant rate of speed.

Current is supplied to battery 48, to charge the battery, through a plurality of collector strips 50, 52, 54 mounted on the lower surface of frame 32 of the vehicle. These collector strips are formed of flexible metallic material and are removably mounted on the bottom of the frame 32 in any convenient manner. The collector strip 50 is located to contact strips C, i.e., the strips of the track connected to ground, while contact strips 52, 54 are positioned to contact strips A, B, respectively and continuously pick up current from the track.

Collectors 52, 54 are electrically connected to the battery 48 to supply charging current to the battery. Since it is desirable to charge the battery with current of only a single polarity, a pair of diodes 56, 58 are respectively connected to collectors 52, 54 to permit current flow of only the desired polarity to pass to battery 48. Thus the collectors simultaneously collect current from each of the strips A, B, but only the strip carrying current of the proper polarity will supply current to battery 48. Since it is normally desirable for the vehicles to be operating on the outermost track of the game, except during passing on the inner lane, the battery is arranged with respect to the motor to operate the motor (and thus drive the vehicle in a forward direction) with current of the polarity used to keep the shiftable vehicles 18, 20 in the outer lane since it is that polarity which will normally be present in the contact strips of the outer lane and the diodes permit only current of that polarity to pass to the battery. In those instances where both shiftable vehicles 18, 20 are operated to shift them into the inner lane, so that the polarity of current in both strips A and B is opposite to that permitted by diodes 56, 58 to pass to battery 48, the battery will continue to power the motor 46 of the toy vehicle so that the drone car continues to move around the track.

In order to limit the amount of current supplied to the battery for charging, a resistor 60 is electrically connected between diodes 56, 58 and battery 48. The battery itself is connected in parallel to motor 46.

In this manner charging current is supplied to the battery during movement of the toy vehicle around track 12 while the battery continuously supplies current to motor 46 to drive the drone at a relatively constant speed around the track. When the toy vehicle game is initially operated and the drone car is placed on the track, current supplied to the drone car through the contact strips A, B, will charge battery 48. The motor 46 will commence operating once the battery is charged sufficiently to supply the necessary operating voltage to the motor. Once the drone starts moving, the battery charge is maintained by the trickle charge supplied to the battery from collectors 52, 54. When the game is stopped, i.e., when power to track 12 is terminated, battery 48 will continue to drive the motor of the drone car for a short period of time, usually, for example, for one or two laps of the track since the battery is of a very low voltage type, which because it is adapted to be trickle charged, need not have a high power capacity or a long discharge life.

Accordingly, it is seen that a relatively simply constructed vehicle and toy vehicle game is provided in which a battery operated vehicle is adapted to move along the track at a relatively constant rate of speed while its battery is trickle charged from one or the other, or even both, of the current supply strips located in the track.

Although an illustrative embodiment of the present invention has been described herein with reference to the accompanying drawings, it is to be understood that the invention is not limited to that precise embodiment, and that various changes and modifications may be effected therein by one skilled in the art without departing from the scope or spirit of this invention.

What is claimed is:

1. A toy vehicle for use in a vehicle game including a track, at least two current supply strips in the track in a path of travel of the toy vehicle thereon through which current of independently variable value and polarity may be supplied, and an electrical ground strip operatively associated with said current supply strips, said toy vehicle including a frame, an electric motor in said frame, at least one drive wheel rotatably mounted in the frame, transmission means for drivingly connecting said motor to said rear wheels, a battery in said vehicle connected to supply power to said motor, means in the vehicle for collecting current from each of said current supply strips in said track and means operatively connected between said collector means and said battery for permitting current of only a predeterming polarity to pass from said current supply strips to said battery for trickle charging the battery as the vehicle is driven about said track.

2. A toy vehicle as defined in claim 1 wherein said battery is connected in parallel to said motor.

3. A toy vehicle as defined in claim 2 wherein said means for charging the battery includes at least one diode between each of said current collecting means and said battery to permit only current of a single predetermined polarity to flow to the battery from said current supply strips.

4. A toy vehicle as defined in claim 3 including a resistor electrically connected between said diodes and said battery.

5. A toy vehicle game comprising a guide track defining a pair of lanes along which two vehicles may move in side by side relation, at least two separate current supply strips in said track in each of said lanes for separately supplying varying current flow of reversible polarity to at least two separate vehicles on said track, and a drone vehicle for use on said track including a body, means for driving said body along said track including an electric motor, a battery in said vehicle connected to supply power to said motor; separate means in said vehicle for collecting current from each of said current supply strips and means connected between said current collecting means and said battery for supplying current of only a predetermined polarity to said battery for trickle charging the battery as the vehicle is driven about said track.

6. A toy vehicle game as defined in claim 5 wherein said battery is connected in parallel to said motor.

7. A toy vehicle as defined in claim 6 wherein said means for charging the battery includes at least one diode connected between each of said current collector means and said battery permitting only current of a single polarity to flow to the battery from each diode's associated current collector means.

8. A toy vehicle game as defined in claim 7 including a resistor electrically connected between said diode and said battery.

9. A toy vehicle game as defined in claim 5 including operator operable control means connected to said strips for enabling the operator to separately supply current of reversible polarity thereto; said separate current collector means in said drone car being laterally spaced from one another a distance equal to the distance between said contact strips to collect current simultaneously from both of said contact strips.

10. A toy vehicle game as defined in claim 9 including a ground contact strip in said track and contact means on said vehicle positioned to engage said contact strip and being connected to said motor in the vehicle to permit current to flow therethrough.

11. A toy vehicle game as defined in claim 9 wherein said current collector means comprise two separate collector strips respectively associated with said current supplying contact strips.

12. A toy vehicle game as defined in claim 11 wherein said means for supplying current of predetermined polarity to the battery comprises a pair of diodes respectively associated with said current collector strips to permit current flow of only a single predetermined polarity to flow to the battery.

13. A toy vehicle game as defined in claim 12 including a resistor electrically connected between said diode and battery to limit current flow thereto.

14. A toy vehicle game as defined in claim 11 wherein said battery is connected in parallel to said motor.

15. A toy vehicle game as defined in claim 5 wherein said track has a relatively smooth track surface in which said current supply strips are located in said pair of lanes whereby said drone car can freely move from one lane to another.

16. A toy vehicle game as defined in claim 15 wherein said track has a pair of parallely side walls and said vehicle has a pair of steering wheels mounted on said vehicle in an angular position with respect to the direction of travel of the vehicle to bias the vehicle against one of said side walls.

17. A toy vehicle game as defined in claim 15 wherein said current supply strips are spaced from said side walls and said current collecting means are located on said vehicle in predetermined positions to align and contact each other when said vehicle moves along and in engagement with said side wall.

* * * * *

UNITED STATES PATENT OFFICE

CERTIFICATE OF CORRECTION

Patent No. 4,078,798 Dated March 14, 1980

Inventor(s) Edwin A. Nielsen

It is certified that error appears in the above-identified patent and that said Letters Patent are hereby corrected as shown below:

Figure 1, add reference numeral 26;

Figure 4, transpose reference numerals 52 and 54;

and

Figure 5:
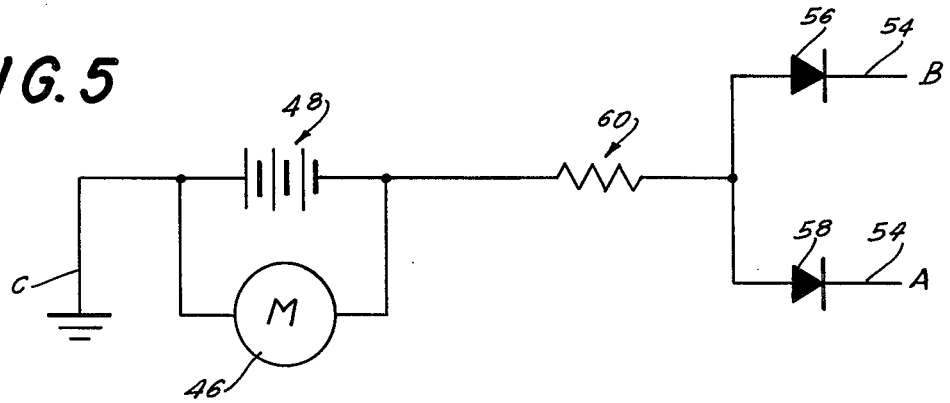
FIG. 5 is a circuit diagram disclosing the trickle charge arrangement used in accordance with the present invention.

Figure 5, change the reference numeral 54 next to the reference numeral 58 to --52--.

Copies of the corrected figures are attached.

FIG. 4

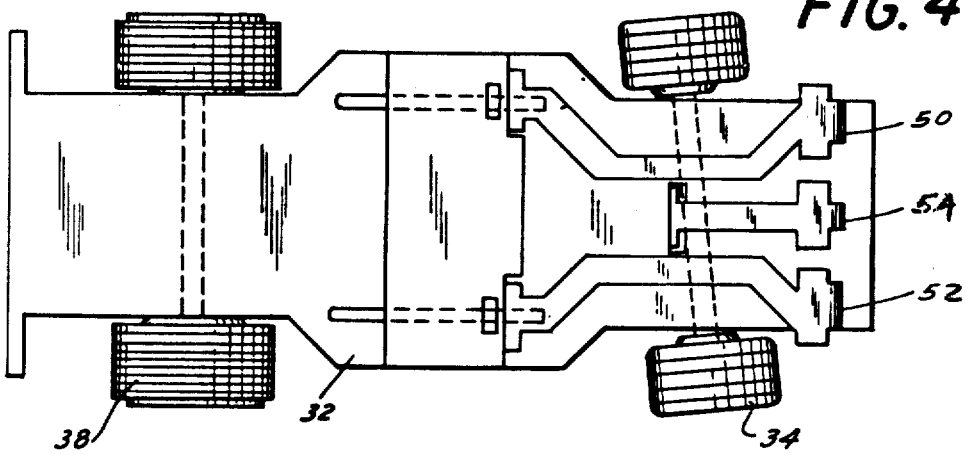

UNITED STATES PATENT AND TRADEMARK OFFICE

CERTIFICATE OF CORRECTION

PATENT NO. : 4,078,798

DATED : March 14, 1980

INVENTOR(S) : Edwin A. Nielsen

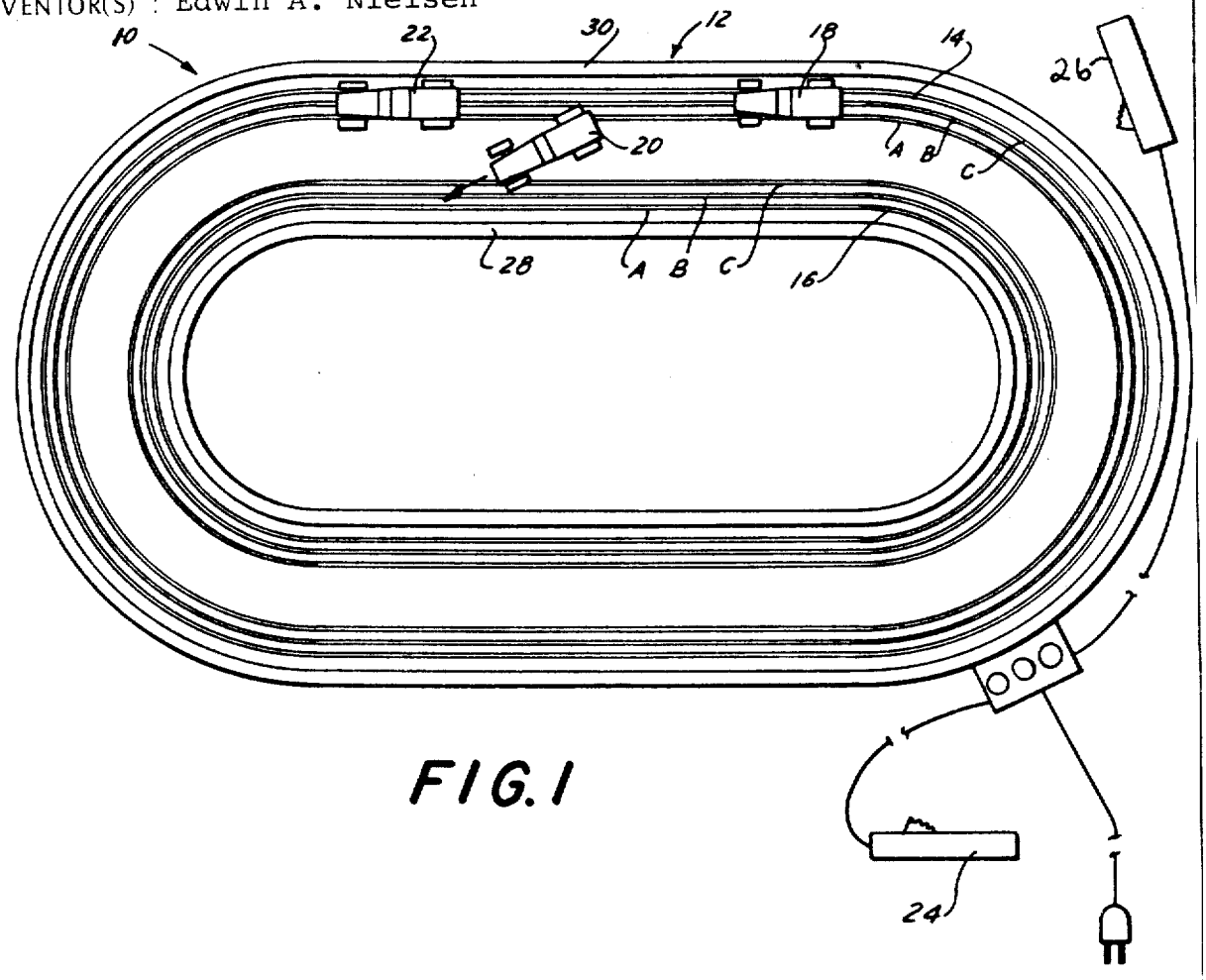

FIG. 1

UNITED STATES PATENT AND TRADEMARK OFFICE

CERTIFICATE OF CORRECTION

PATENT NO. : 4,078,798

DATED : March 14, 1980

INVENTOR(S) : Edwin A. Nielsen

It is certified that error appears in the above—identified patent and that said Letters Patent is hereby corrected as shown below:

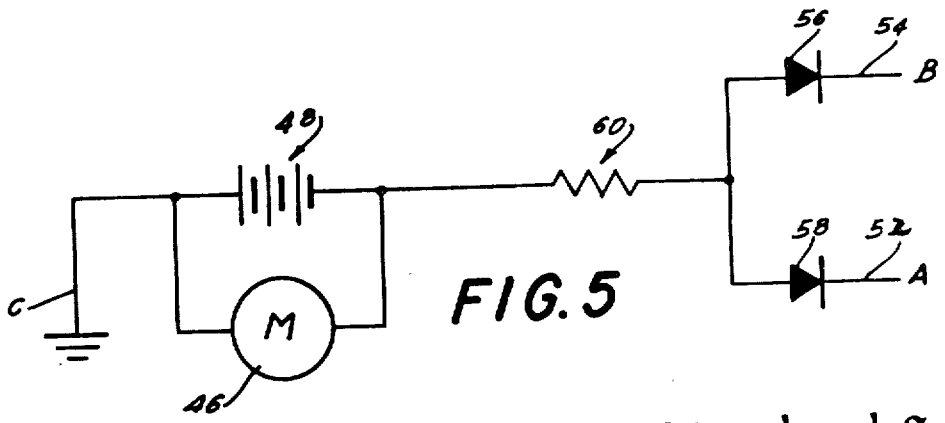

FIG. 5

Signed and Sealed this

Twenty-ninth Day of July 1980

[SEAL]

Attest:

SIDNEY A. DIAMOND

Attesting Officer

Commissioner of Patents and Trademarks